US005832691A

United States Patent [19]

Callahan et al.

[11] Patent Number: 5,832,691

[45] **Date of Patent: *Nov. 10, 1998**

[54] COMPOSITE BEAM

[76] Inventors: Robert M. Callahan, 270 White Oak Dr., Blue Ridge, Va. 24064; Ronald B. Shiflett, Rt. 2, Box 562, Goodview, Va. 24095

[ * ] Notice: The term of this patent shall not extend beyond the expiration date of Pat. No. 5,625,997.

[21] Appl. No.: 848,837

[22] Filed: May 5, 1997

Related U.S. Application Data

[63] Continuation-in-part of Ser. No. 175,605, Dec. 30, 1993, abandoned, and a continuation-in-part of Ser. No. 204,524, Mar. 1, 1994, abandoned, and a continuation-in-part of Ser. No. 415,945, Apr. 3, 1995, Pat. No. 5,625,997.

[51] Int. Cl.[6] ..... E04C 3/292

[52] U.S. Cl. ..... 52/737.3; 52/731.1; 52/731.5; 52/737.6

[58] Field of Search ..... 52/664, 730.1, 52/730.4, 731.1, 731.2, 731.5, 731.9, 732.3, 732.1, 733.2, 736.3, 737.3, 737.4, 737.6, 738.1

[56] References Cited

PUBLICATIONS

Product Advertisement for HL Stud Corporation, p. 19, The Virginia Builder, Official Publication of the Home Builder's Association of VA, Published by the Mid–Atlantic Trade Exposition, Inc., Jan.–Feb. '94 Issue.

*Primary Examiner*—Carl D. Friedman
*Assistant Examiner*—Kevin D. Wilkens
*Attorney, Agent, or Firm*—Stephen R. Greiner

[57] ABSTRACT

A composite beam including an elongated metallic shell and a pierceable insert contained within at least one end of the elongated metal shell. A bracket abutting the pierceable insert supports such within the elongated metallic shell. The bracket includes a pair of longitudinal plates for secure attachment to the elongated metallic shell.

16 Claims, 1 Drawing Sheet

COMPOSITE BEAM

CONTINUING APPLICATION DATA

This application is a continuation-in-part of the application, Ser. No. 08/175,605, filed Dec. 30, 1993, now abandoned and a continuation-in-part of the application, Ser. No. 08/204,524, filed Mar. 1, 1994, now abandoned and a continuation-in-part of the application, Ser. No. 08/415,945, filed Apr. 3, 1995, now U.S. Pat. No. 5,625,997 .

FIELD OF THE INVENTION

The present invention relates generally to static structures and, more particularly, to a composite beam including a pierceable nonmetal component for retaining a penetrating fastener.

BACKGROUND OF THE INVENTION

In our copending patent application, Ser. No. 08/415,945, a composite beam was described which is constructed largely of metal yet is capable of being connected to other building members using conventional, wood framing techniques. While the '945 application described the best way known to us to make our composite beam at the time of filing on Apr. 3, 1995, valuable improvements to the composite beam have been developed by us since. It is now our intention to protect these improvements.

SUMMARY OF THE INVENTION

It is a principal object of the present invention to provide an improved composite beam of the type described in our '945 application which is stronger and be less costly to manufacture.

Briefly, the composite beam in accordance with this invention features a C-shaped shell including an intermediate wall, a pair of side walls extending from the intermediate wall, and a pair of flanges extending from the side walls in a common plane parallel to the intermediate wall. A wooden block and a metallic bracket are contained within one end of the shell with the bracket serving as a support for the wooden block. The bracket includes a lateral plate, extending between the intermediate wall and the flanges of the shell, and a pair of longitudinal plates extending at right angles from the intermediate wall. The longitudinal plates are respectively welded to the intermediate wall and flanges of the elongated metallic shell.

It is an object of the invention to provide improved elements and arrangements thereof in a composite beam for the purposes described which is simple in construction, light in weight and fully dependable in use.

These and other objects of the present invention will become readily apparent upon further review of the following specification and drawings.

BRIEF DESCRIPTION OF THE DRAWINGS

The present invention may be more readily described with reference to the accompanying drawings, in which.

Similar reference characters denote corresponding features consistently throughout the accompanying drawings.

DETAILED DESCRIPTION OF THE PREFERRED EMBODIMENTS

Figure 1:
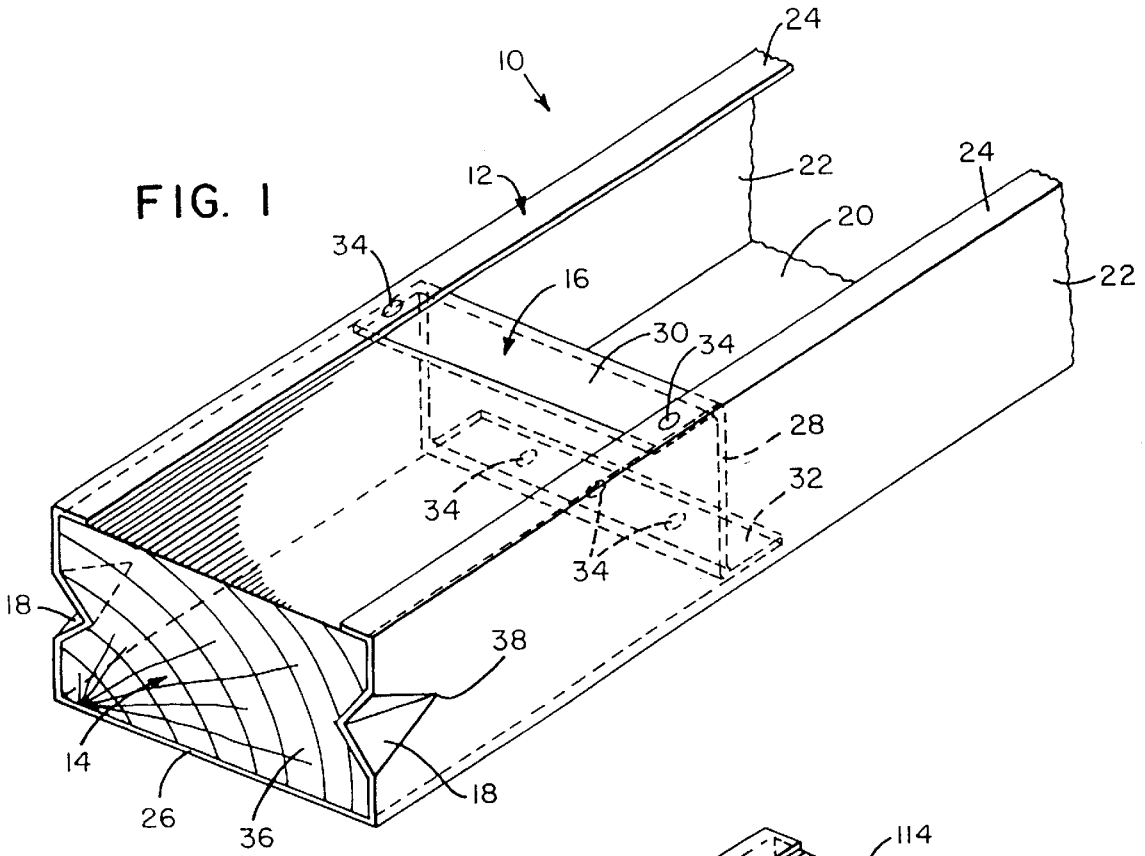
FIG. 1 is a perspective view of a composite beam in accordance with the present invention.

Referring now to FIG. 1, an improved composite beam in accordance with the present invention is shown at 10. The beam 10 includes an elongated shell 12 having a pierceable insert 14 within one or both of its ends. A Z-shaped bracket 16 is fitted within the shell 12 to serve as a support for the insert 14. Folds or indentions 18 in the shell 12 retain the insert 14 within the shell and against the bracket 16.

The shell 12 is formed by bending a thin, rectangular strip of sheet metal, such as galvanized steel, into a "C" shape. The finished shell 12 includes an intermediate wall 20 and a pair of parallel side walls 22 extending outwardly at right angles from one side of the intermediate wall 20. A pair of inwardly directed flanges 24 are rolled or bent into a position parallel with the intermediate wall 20 from the free ends of the side walls 22. The respective ends of the intermediate wall 20, the side walls 22 and the flanges 24 are cut so as to define a substantially planar abutment surface 26 at the end of the shell 12.

The bracket 16 comprises a thin, rectangular sheet of galvanized steel, or other suitable metal, bent into the shape of a "Z". The bracket 16, thus, includes at a lateral plate 28 and a pair of longitudinal plates 30 and 32 extending outwardly at right angles from the opposing sides of the lateral plate 28. The lateral plate 28 bridges the gap between the intermediate wall 20 and the flanges 24 of the shell 12. The longitudinal plates 30 and 32, on the other hand, respectively engage the interior surfaces of the flanges 24 and intermediate wall 20 and are secured thereto by a number of welds 34.

The pierceable insert 14 comprises a rectangular block of wood or other suitable material. The insert 14 is sized to snugly engage the walls 20 and 22 and flanges 24 of the shell 12 as well as the plates 28 and 30 of the bracket 16. The flat side 36 of the insert 14 opposite the lateral plate 28 of the bracket 16 is positioned flush with the abutment surface 26 at the end of the shell 12. To receive a standard framing nail (not shown) driven longitudinally into the flat side 36 of the insert 14, the length of the insert 14 is at least 4 inches (10 cm).

Each of the side walls 22 is provided with a fold or indention 18 which projects into the insert 14 to retain the insert within the shell 12. Each indention 18 is V-shaped and tapers in depth and width from approximately 0.5 inches (1.25 cm) at its end in the abutment surface 26 of the shell 12 to zero at its terminal end 38 about 1 inch (2.54 cm) away. By varying the depth and width of each indention 18 from end to end as described, the insert 14 can be firmly wedged against the bracket 16 without tearing and weakening the load-bearing, side walls 22 of shell 12.

The indentions 18 may be formed by means of a hydraulic or mechanical vise (not shown). With the insert 14 serving as a backing to the side walls 22 duing formation of the indentions 18, the indentions 18 formed in the vise are immediately received within the insert 14 without the necessity of further tooling.

The longitudinal plate 30 serves to cap the insert 14 and prevent the insert from splintering or splitting during use. The longitudinal plate 30 is provided with a length which is shorter than that of the insert 14 so as to leave a side of the insert 14 exposed to receive nails during use.

Figure 2:
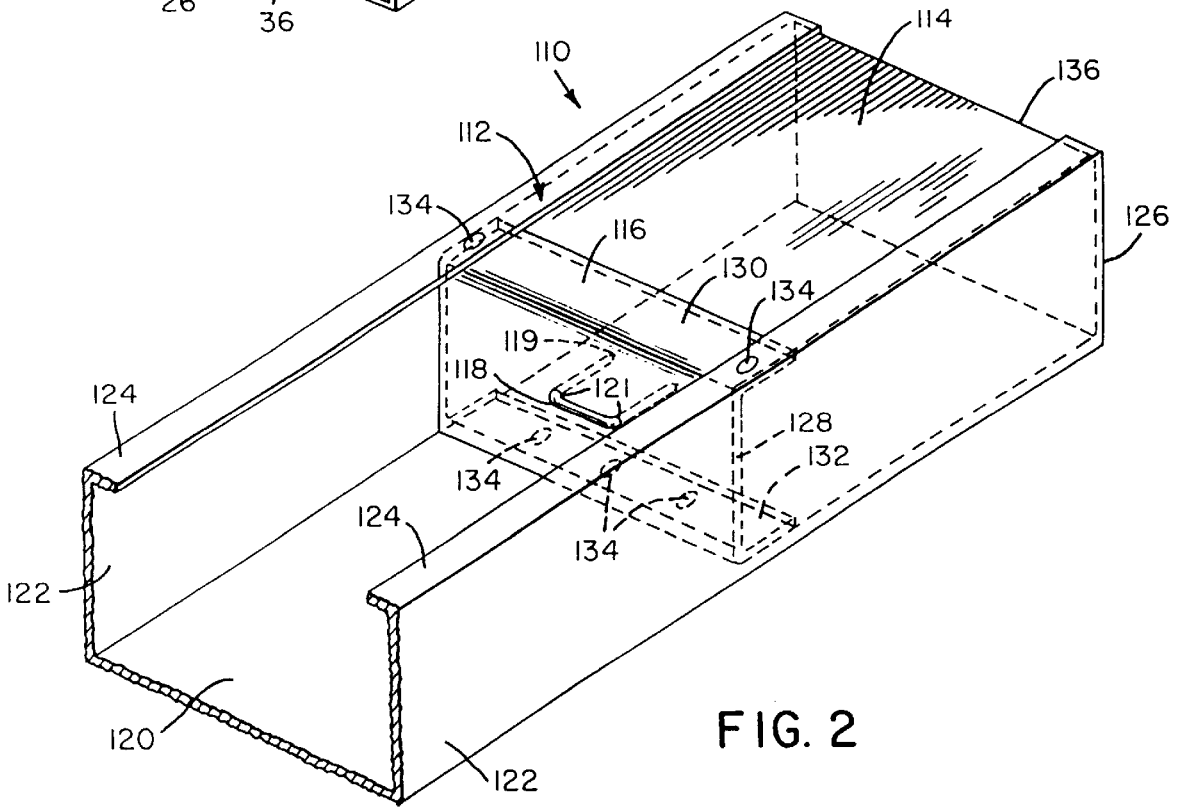
FIG. 2 is a perspective view of an alternative composite beam in accordance with the present invention.

Referring now to FIG. 2, an alternative embodiment of a composite beam is illustrated generally at 110. As may be seen, the beam 110 includes elements that correspond generally to those of the improved composite beam 10 described in detail hereinabove. The shell 112 and bracket 116, however, have been somewhat modified. It is these modifications which will be emphasized below.

The beam 110 includes a metallic shell 112 having a pierceable insert 114 within at least one its ends. A C-shaped bracket 116 is fitted within the shell 112 to support the insert 114. A staple 118 is driven through the bracket 116 to retain the insert 114 within the shell 112 and against the bracket 116.

The shell 112 includes an intermediate wall 120, a pair of parallel side walls 122, and a pair of inwardly directed flanges 124. The respective ends of the intermediate wall 120, the side walls 122 and the flanges 124 are cut to define a substantially planar abutment surface 126 at the end of the shell 112.

The bracket 116 comprises a rectangular sheet of metal bent into the shape of a "C". The bracket 116 includes a lateral plate 128 and a pair of longitudinal plates 130 and 132 extending outwardly at right angles from one side of the lateral plate 128. Like the lateral plate 28 of the beam 10, the lateral plate 128 bridges the gap between the intermediate wall 120 and the flanges 124. The longitudinal plates 130 and 132, however, respectively engage the interior surfaces of the flanges 124 and intermediate wall 120 and are secured thereto by a number of welds 134.

The pierceable insert 114 comprises a rectangular block of wood or other suitable material. The insert 114 is sized to snugly engage the walls 120 and 122 and flanges 124 of the shell 112 as well as the plates 128, 130 and 132 of the bracket 116. The flat side 136 of the insert 114 opposite the lateral plate 128 of the bracket 116 is positioned flush with the abutment surface 126 at the end of the shell 112. The length of the insert 114 is at least 4 inches (10 cm).

The pointed ends 119 of the U-shaped metal loop forming the staple 118 are imbedded in the insert 114. If desired, passage of the pointed ends 119 through the lateral plate 128 of the bracket 116 may be facilitated by predrilling a pair suitably spaced holes 121 in the lateral plate 128 prior to driving the pointed ends 119 home.

From the foregoing, it should be apparent that the improved composite beam provides the benefits of a steel framing member while preserving the advantages of conventional construction methods utilizing wood. The large surfaces of attachment between the bracket and shell within the improved composite beam are believed to provide a product which is less costly to manufacture and, yet, is stronger and capable of supporting greater loads than its technological predecessors.

While the invention has been described with a high degree of particularity, it will be appreciated by those skilled in the art that numerous modifications and substitutions may be made thereto. For example, a staple 118 found in the beam 110 may be substituted for the indentions 18 in the beam 10 and vice versa. Further, the staple 118 and indentions 18 may be featured together in a single beam 10. Therefore, it is to be understood that the present invention is not limited to the two embodiments described above, but encompasses any and all embodiments within the scope of the following claims.

We claim:

1. A composite beam, comprising:

an elongated shell including:

an intermediate wall;

a pair of side walls integral with said intermediate wall and extending at a right angle therefrom; and, a pair of flanges integral with said pair of side walls and extending at a right angle therefrom in a common plane parallel to said intermediate wall;

a pierceable insert positioned within one end of said elongated shell; and, a bracket positioned within said elongated shell and abutting said pierceable insert for supporting said pierceable insert, said bracket including:

a lateral plate extending between said intermediate wall and said flanges of said elongated shell;

a first longitudinal plate secured to said intermediate wall of said elongated shell, said first longitudinal plate being integral with said lateral plate and extending at a right angle therefrom; and, a second longitudinal plate secured to said flanges of said elongated shell, said second longitudinal plate being integral with said lateral plate and extending at a right angle therefrom.

2. The composite beam according to claim 1 wherein said elongated shell and said bracket are formed of metal and said first and second longitudinal plates are secured to said elongated shell by welds.

3. The composite beam according to claim 1 wherein at least one of said side walls of said elongated shell includes an indention which projects into said pierceable insert for retaining said pierceable insert within said elongated shell and against said bracket.

4. The composite beam according to claim 1 wherein each of said side walls of said elongated shell includes an indention which projects into said pierceable insert for retaining said pierceable insert within said elongated shell and against said bracket.

5. The composite beam according to claim 1 further comprising a staple penetrating both said lateral plate of said bracket and said pierceable insert for retaining said pierceable insert within said elongated shell and against said bracket.

6. The composite beam according to claim 1 wherein said first and second longitudinal plates extend from the same side of said lateral plate so as to provide said bracket with a C-shaped cross section.

7. The composite beam according to claim 1 wherein said first and second longitudinal plates extend from opposite sides of said lateral plate so as to provide said bracket with a substantially Z-shaped cross section.

8. The composite beam according to claim 1 wherein said second longitudinal plate has a length shorter than that of said pierceable insert.

9. A composite beam, comprising:

an elongated metallic shell having a C-shaped cross section, said elongated metallic shell including:

an intermediate wall;

a pair of side walls integral with said intermediate wall and extending at a right angle therefrom; and, a pair of flanges integral with said pair of side walls and extending at a right angle therefrom in a common plane parallel to said intermediate wall; and, a wooden block contained within one end of said elongated metallic shell; and, a metallic bracket contained within said elongated metal shell serving as an abutment for said wooden block, said metallic bracket including:

a lateral plate extending between said intermediate wall and said flanges of said elongated metallic shell;

a first longitudinal plate welded to said intermediate wall of said elongated metallic shell, said first longitudinal plate being integral with said lateral plate and extending at a right angle therefrom; and, a second longitudinal plate welded to said flanges of said elongated metallic shell, said second longitudinal plate being integral with said lateral plate and extending at a right angle therefrom.

10. The composite beam according to claim 9 wherein each of said side walls of said elongated metallic shell includes an indention which projects into said wooden block for retaining said wooden block within said elongated metallic shell and against said metallic bracket.

11. The composite beam according to claim 9 further comprising a staple penetrating both said lateral plate of said metallic bracket and said wooden block for retaining said wooden block within said elongated metallic shell and against said metallic bracket.

12. The composite beam according to claim 9 wherein said first and second longitudinal plates extend from the same side of said lateral plate so as to provide said metallic bracket with a C-shaped cross section.

13. The composite beam according to claim 9 wherein said first and second longitudinal plates extend from opposite sides of said lateral plate so as to provide said metallic bracket with a substantially Z-shaped cross section.

14. The composite beam according to claim 9 wherein said second longitudinal plate has a length shorter than that of said wooden block.

15. A composite beam, comprising:

an elongated metallic shell having a C-shaped cross section, said elongated metallic shell including:

an intermediate wall;

a pair of side walls integral with said intermediate wall and extending at a right angle therefrom; and, a pair of flanges integral with said pair of side walls and extending at a right angle therefrom in a common plane parallel to said intermediate wall;

a metallic bracket located within one end of said elongated metal shell, said metallic bracket including:

a lateral plate extending between said intermediate wall and said flanges of said elongated metallic shell;

a first longitudinal plate welded to said intermediate wall of said elongated metallic shell, said first longitudinal plate being integral with said lateral plate and extending at a right angle therefrom; and, a second longitudinal plate welded to said flanges of said elongated metallic shell, said second longitudinal plate being integral with said lateral plate and extending at a right angle therefrom; and, a wooden block in said elongated metallic shell and abutting said metallic bracket, said block being sized to snugly engage said intermediate wall, said side walls and said flanges of said elongated metallic shell as well as said second longitudinal plate and said lateral plate of said metallic bracket.

16. The composite beam according to claim 15 wherein at least one of said side walls of said elongated metallic shell includes an indention which projects into said wooden block for retaining said wooden block within said elongated shell and against said bracket.

* * * * *